US006003671A

United States Patent [19]

McDonough et al.

[11] Patent Number: 6,003,671

[45] Date of Patent: Dec. 21, 1999

[54] CUPCAKE STORAGE CONTAINER

[76] Inventors: Renee Ann McDonough, 20062 Woodside, Harper Woods, Mich. 48225; Colleen Marie Patrona, 19381 Kenosha, Harper Woods, Mich. 48225; Peggy Ann McGinnis, 19700 Kingsville, Detroit, Mich. 48225; Brenda J. Marlowe, 20460 Kenosha, Harper Woods, Mich. 48225; Denise Marie McGinnis, 50202 Jim Dr., New Baltimore, Mich. 48047; Robert Joseph McGinnis, 23007 13 Mile Rd., St. Claire Shores, Mich. 48082

[21] Appl. No.: 08/980,543

[22] Filed: Dec. 1, 1997

Related U.S. Application Data

[60] Provisional application No. 60/032,305, Dec. 2, 1996.

[51] Int. Cl.[6] ..... B65D 83/38

[52] U.S. Cl. ..... 206/493; 206/564; 220/675; 426/124; 426/128

[58] Field of Search ..... 99/426; 206/558, 206/560, 564, 493; 220/669, 672, 674, 675, 780; 249/121; 426/113, 124, 128

[56] References Cited

U.S. PATENT DOCUMENTS

| | | | |
|---|---|---|---|
| D. 218,155 | 7/1970 | Britt . | |
| D. 322,402 | 12/1991 | Budzbanowski . | |
| D. 331,013 | 11/1992 | Hamamura . | |
| D. 361,714 | 8/1995 | Krupa . | |
| D. 363,661 | 10/1995 | Lambelet, Jr. et al. . | |
| 2,614,727 | 10/1952 | Robinson | 220/780 |
| 2,685,316 | 8/1954 | Krasno | 220/672 |
| 2,687,157 | 8/1954 | Cowan . | |
| 2,729,375 | 1/1956 | Pace . | |
| 2,845,104 | 7/1958 | Frankel . | |
| 3,043,354 | 7/1962 | Fitzgerald . | |
| 3,483,908 | 12/1969 | Donovan | 220/675 |
| 3,530,917 | 9/1970 | Donovan | 426/128 |
| 3,874,548 | 4/1975 | Buff, Jr. . | |
| 3,977,595 | 8/1976 | Hillgenberg . | |
| 4,013,214 | 3/1977 | Hansen et al. . | |
| 4,014,450 | 3/1977 | Girotti et al. | 220/675 |
| 4,096,986 | 6/1978 | Florian . | |
| 4,183,446 | 1/1980 | Davis . | |
| 4,270,490 | 6/1981 | Kopp . | |
| 4,298,133 | 11/1981 | Davis . | |
| 4,383,638 | 5/1983 | Bixler . | |
| 4,753,336 | 6/1988 | Ritter . | |
| 4,787,552 | 11/1988 | Natori . | |
| 4,813,543 | 3/1989 | Goldberg | 206/507 |
| 4,915,251 | 4/1990 | Payne . | |
| 5,026,958 | 6/1991 | Palacios . | |
| 5,094,355 | 3/1992 | Clark et al. . | |
| 5,152,710 | 10/1992 | Montgomery . | |
| 5,190,151 | 3/1993 | Dietterich | 220/675 |
| 5,220,999 | 6/1993 | Goulette . | |
| 5,429,833 | 7/1995 | Wyslotsky . | |
| 5,501,141 | 3/1996 | Mendez et al. . | |
| 5,709,304 | 1/1998 | Credle, Jr. | 220/675 |

*Primary Examiner*—Jim Foster
*Attorney, Agent, or Firm*—Susan M. Cornwall; Lynn E. Cargill

[57] ABSTRACT

A container includes two container members which, when together, form an interior which includes a cup sized and shaped to hold a cupcake. The cup has a bottom, sides, and at least one protrusion extending inwardly from at least one of the sides. The protrusion is positioned and protrudes inwardly enough such that, when a cupcake in a cupcake baking liner is placed in the cup, the protrusion is below the top of the cupcake baking liner and the protrusion holds the cupcake in a substantially stationary position. One of the members may be a top member and the other, a bottom member. The bottom member (the member with the cup(s)) may have vertical pleats in opposite sides of the cup(s). The pleats are spreadable at the top of the cup(s) to allow easier removal of a cupcake. The pleats are also compressible to allow the member to better hold a cupcake. The bottom member may also have an upwardly projecting midline crease in the bottom of the cup when the pleats are open, the crease extending from the pleats on one side of the cup to the pleats on the other side of the cup. When a crease is provided, the bottom of the cup is flexible enough to allow the crease to flatten to some degree when a cupcake is placed in the bottom member, thereby helping to close the pleats.

15 Claims, 6 Drawing Sheets

CUPCAKE STORAGE CONTAINER

This application claims the benefit of U.S. Provisional Application Ser. No. 60/032,305 filed Dec. 2, 1996.

BACKGROUND OF THE INVENTION

1. Field of the Invention

The present invention relates generally to storage containers and, more particularly, to storage containers for cupcakes.

2. Description of the Related Art

Disposable or recyclable containers for frosted cupcakes are widely used today by grocery store bakeries and other commercial bakeries. These containers often have a container bottom into which the cupcakes are placed and a container lid which fits over the container bottom and locks to the container bottom in some fashion. These containers are useful with respect to keeping the cupcakes from touching one another and keeping the cupcakes sealed from the environment. However, when the containers, storing frosted cupcakes, tip or turn over, the cupcakes move around inside the container, often causing the frosting to stick to the container lid and to ruin any design on the frosting. There is, therefore, a need for a cupcake storage container which keeps the cupcakes from moving around inside the storage container, even when the container is tipped or turned over.

In the reusable food storage container market, there are various sizes of containers available. However, there are no reusable containers designed specifically for frosted cupcakes. As with the disposable/recyclable container market, it would be useful if a reusable storage container were designed to keep the cupcakes from moving around inside the storage container.

Therefore, the present invention seeks to provide a cupcake storage container which reduces the movement of a stored cupcake inside the container even during movement of the container.

SUMMARY OF THE INVENTION

We have invented a cupcake storage container that will hold a baked cupcake in such a way that the cupcake will not move within the container, thereby essentially eliminating the possibility of the frosting becoming smeared inside the top of the container if it becomes tipped sideways or upside down. The integrity of the frosting can remain intact. We envision that there will be many applications for such a container including bakeries, school lunch boxes, and fresh baked goods deliveries. Even carrying fresh cupcakes home from the bakery or grocery was previously dangerous for a perfectly decorated cupcake, especially painstakingly decorated cupcakes. The present invention includes numerous designs to ensure safe transport for frosted cupcakes.

In accordance with the present invention, a cupcake storage container is disclosed which includes at least one container member. In the event that two container members are used, they may be formed as one unitary piece. In this case, the container members form an interior when connected together, and the interior includes a cup which is sized and shaped to hold a cupcake in a cupcake baking liner. The cup has a bottom, sides extending upwardly from the bottom, and at least one protrusion extending inwardly from at least one of the sides either near the top of the cup or near the bottom. The protrusion is positioned and protrudes inwardly enough such that, when a cupcake in a cupcake baking liner is placed in the cup, the protrusion may be either below the top of the cupcake baking liner, above the liner, or at the bottom of the cup. In any of these positions, the protrusion holds the cupcake in a substantially stationary position relative to the container.

One of the container members may be a top container member while the other may be a bottom container member. The bottom container member (the container with the cup (s)) may have vertical pleats in opposite sides of the cup(s). The pleats are spreadable at the top of the cup(s) to allow easier removal of a cupcake from the bottom container member. The pleats are also compressible to allow the protrusion to come into contact with the cupcake itself (if the protrusion is above the baking liner); the cupcake baking liner (if the protrusion is below the level of the liner); or the bottom of the cupcake baking liner (if the protrusion is near the bottom of the cup).

The bottom container member may also have an upwardly projecting midline crease in the bottom of the cup when the pleats are open, the crease extending from the pleats on one side of the cup to the pleats on the other side of the cup. When a crease is provided, the bottom of the cup is flexible enough to allow the crease to flatten to some degree when a cupcake is placed in the bottom container member, thereby helping to close the pleats.

Other advantages of the present invention will be readily appreciated as the same becomes better understood after reading the subsequent description taken in conjunction with the appendant drawings.

DESCRIPTION OF THE PREFERRED EMBODIMENT(S)

Figure 1:
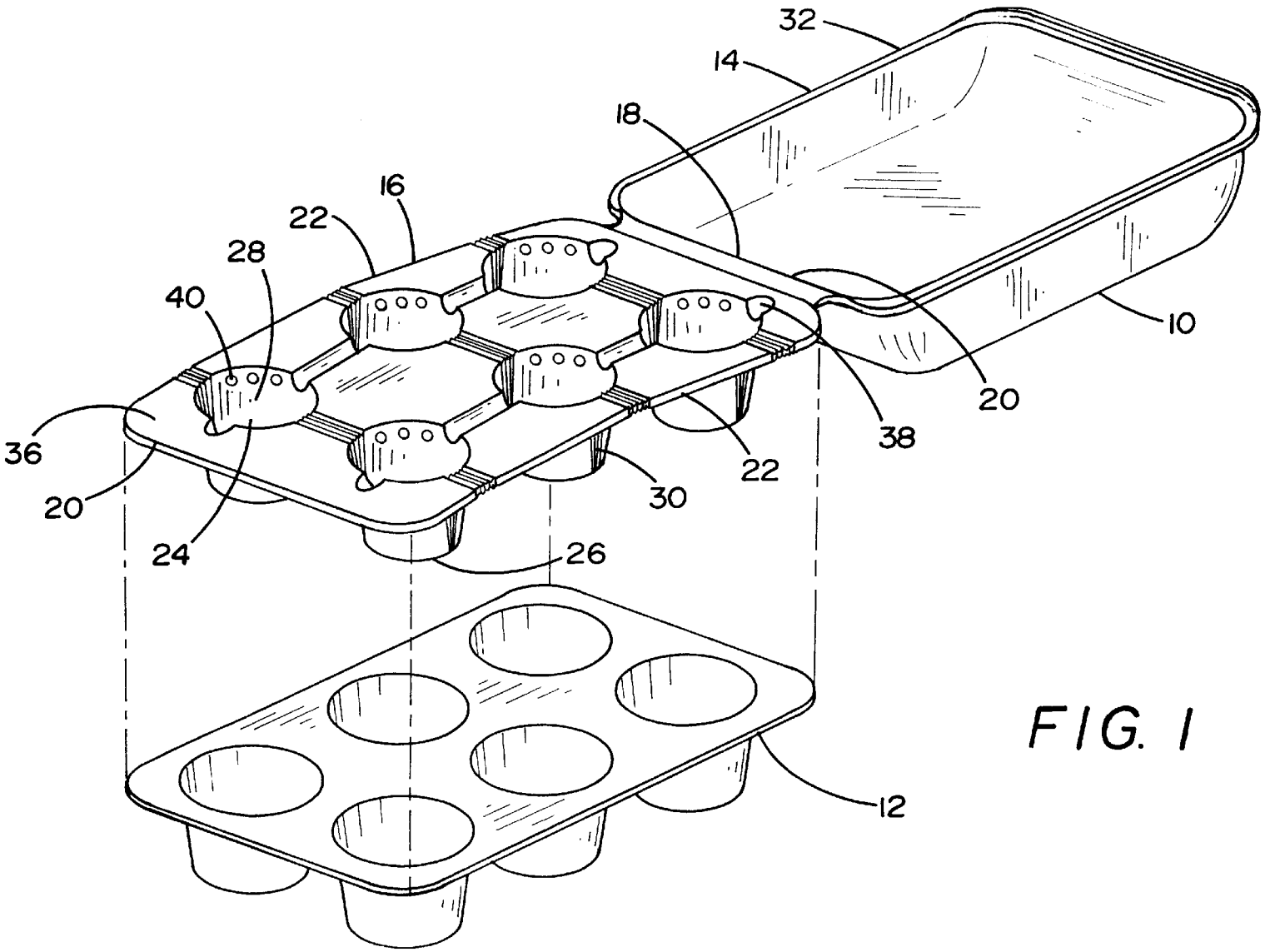
FIG. 1 is a perspective view of a cupcake storage container including a top container member and a bottom container member according to the present invention shown in exploded relationship with a shaping tray.
Figure 2:
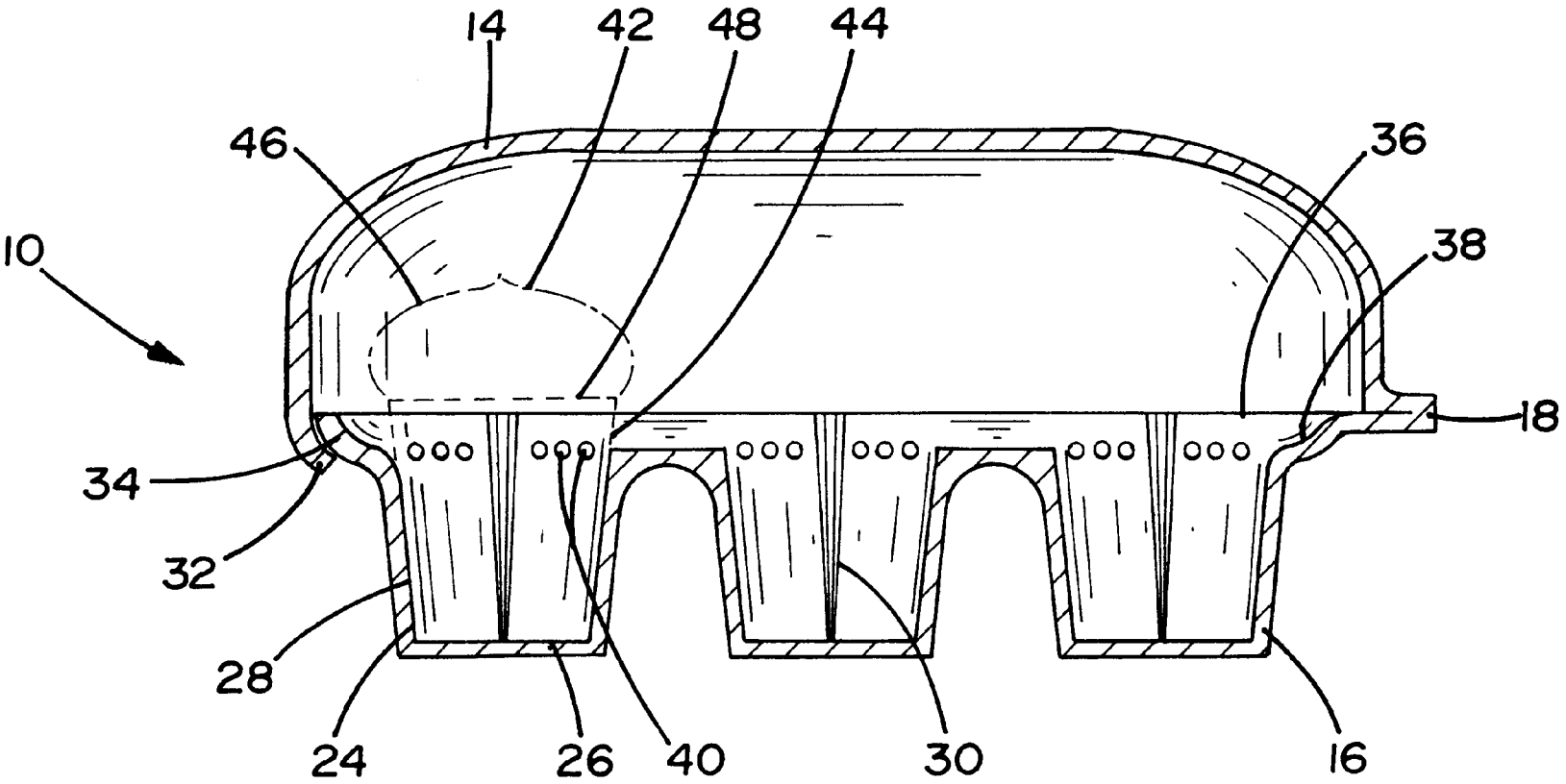
FIG. 2 is a cross sectional view of the cupcake storage container of FIG. 1, only in the closed position.

Referring to the Drawings, wherein like reference characters designate corresponding parts throughout the Figures thereof, FIGS. 1 and 2 help illustrate one cupcake storage container of the present invention which is generally indicated by reference numeral 10. In FIG. 1, cupcake storage container 10 is shown in exploded relationship with shaping tray 12 wherein the dot-dash lines show the proper placement of container 10 with shaping tray 12. Cupcake storage container 10 has lid or top container member 14 which is connected to bottom container member 16 at hinge 18.

Bottom container member 16 has ends 20 and sides 22 and includes six cups 24 which are each sized and shaped to hold a cupcake in a cupcake baking liner, such as those formed of paper or foil. Alternatively, similar cupcake storage containers may be designed with more or less cups than the six shown.

Each cup 24 includes bottom 26, sides 28 extending upwardly from bottom 26, and vertical pleats 30 in opposite sides of the cup. Pleats 30 are spreadable to allow easier removal of a cupcake from bottom container member 16 and compressible to better hold a cupcake when contained in the container. Pleats 30 are fixed in a compressed state or essentially originate at bottom 26 of each cup 24 yet spreadable at the top of the cup.

In FIG. 1, bottom container member 16 is shown in an arced position wherein ends 20 are bent downwardly so that pleats 30 are caused to spread open at the top. The spreading of the pleats allows for easier removal of any cupcakes stored in container 10. To enable bottom container member 16 to bend, it is preferred that member 16 be formed of a flexible material or be thin enough to allow for the bending of the member without cracking the material of construction.

When loading cupcakes into container 10, it may be useful to use shaping tray 12. Shaping tray 12 is a rigid tray having the same number of cups and the same general dimensions as bottom container member 16. Cupcakes may be loaded when bottom container member 16 is arced and, then, bottom container member 16 may be placed in shaping tray 12 to straighten bottom container member 16 and to cause pleats 30 to close. Once bottom container member 16 is straightened, top container member 14 may be pivoted over bottom container member 16, and container 10 may be closed in a sealing, locking manner. Container 10 is then removed from shaping tray 12, and shaping tray 12 is then ready for use for loading the next container 10.

An alternative way of using shaping tray 12 is by placing bottom container member 16 in shaping tray 12 before loading any cupcakes. Cupcakes may then be loaded into bottom container member 16 and container 10 may then be closed.

FIG. 2 shows a longitudinal cross sectional view of container 10 in the closed position. Although other designs are possible, FIG. 2 shows that top container member 14 has lip 32 which fits over edge 34 of bottom container member 16 in a mating fashion, thereby sealing and locking the container members together.

As shown, top and bottom container members 14 and 16 are hinged at one of the ends 20 of bottom container member 16. Alternatively, top and bottom container members 14 and 16 may be hinged at one of the sides 22 or members 14 and 16 may be separate, unhinged pieces. When top and bottom members 14 and 16 are hinged, the hinge may run parallel or perpendicular to the direction of the pleats.

Bottom container member 16 has upper surface 36 which encircles the six cups 24 and includes indentations 38 on opposite sides of each of the cups to provide space for one's fingers to more easily grasp a cupcake and lift the cupcake from bottom container member 16.

Each cup 24 of container 10 has a plurality of protrusions 40 extending inwardly from sides 28. Protrusions 40 are positioned and protrude inwardly enough to hold frosted cupcakes in cups 24 so that the cupcakes are held substantially stationary inside container 10 even if container 10 is tipped on its side or turned upside down. The term "substantially stationary" is used to mean that the cupcakes contained in container 10 are usually held in place enough so that most, if not all, of any frosting on the cupcakes is left undisturbed when the container is tipped or turned over.

FIG. 2 also illustrates the positioning of cupcake 42 contained in container 10. The dashed lines represent cupcake baking liner 44 of cupcake 42, and the dot-dash lines represent frosting 46 of cupcake 42. If a baking liner is not used, the dashed lines may represent the cake portion of the cupcake which typically has vertical sides which angle outwardly as they approach the top of the cupcake. Protrusions 40 are positioned just below top 48 of cupcake baking liner 44 or below the top of the vertical sides of the cupcake. Although other locations for the protrusions are possible, it is preferred that the protrusions be below top 48 of cupcake baking liner 44. It is also preferred that protrusions 40 are sized to press fit against the cupcake to hold the cupcake in place. Alternatively, however, protrusions 40 may be shaped (e.g., pointed) and sized to pierce into the cupcake to hold it in place.

In this embodiment, protrusions 40 are bumps which are positioned and protrude inwardly enough such that, when a cupcake in a cupcake baking liner is placed in cup 24, protrusions 40 hold the cupcake in a substantially stationary position relative to the container. It is preferred that protrusions 40 are spaced away from pleats 30 as it has been found that if the protrusions are too close to the pleats, the protrusions drag against the baking liner when the pleats are being opened and closed.

Figure 3:
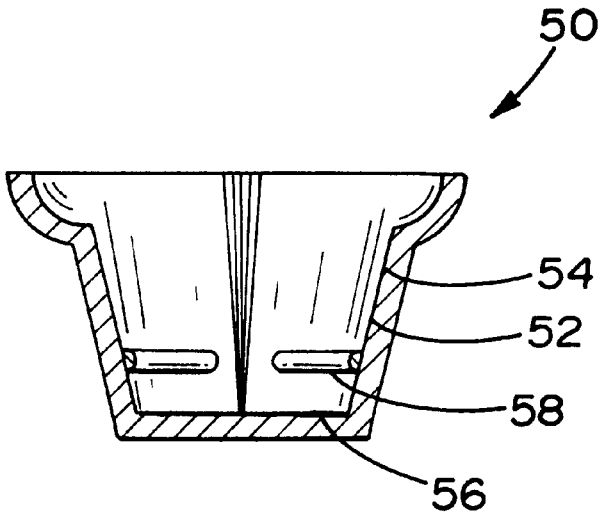
FIG. 3 is a cross sectional view of a bottom container member of another embodiment of a cupcake storage container according to the present invention.

Alternative to the shape and placement of protrusions 40 shown in FIGS. 1 and 2, the protrusion(s) may be of another form and be positioned at another location in the cup, so long as the protrusion(s) functions to hold a cupcake in place. For example, FIG. 3 shows a cross section of bottom container member 50 which has cup 52 with sides 54, bottom 56, and annular protrusion or ring 58 extending inwardly from sides 54 near bottom 56.

Figure 4:
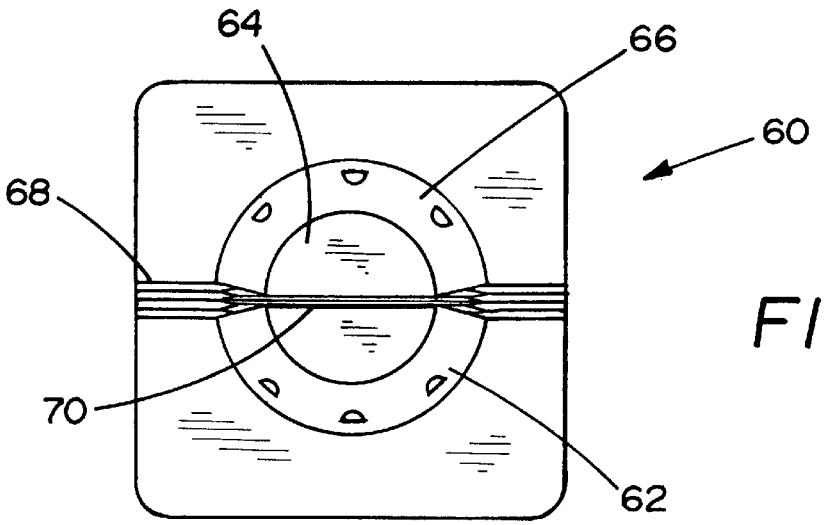
FIG. 4 is a top view of a bottom container member of yet another embodiment of a cupcake storage container according to the present invention.
Figure 5:
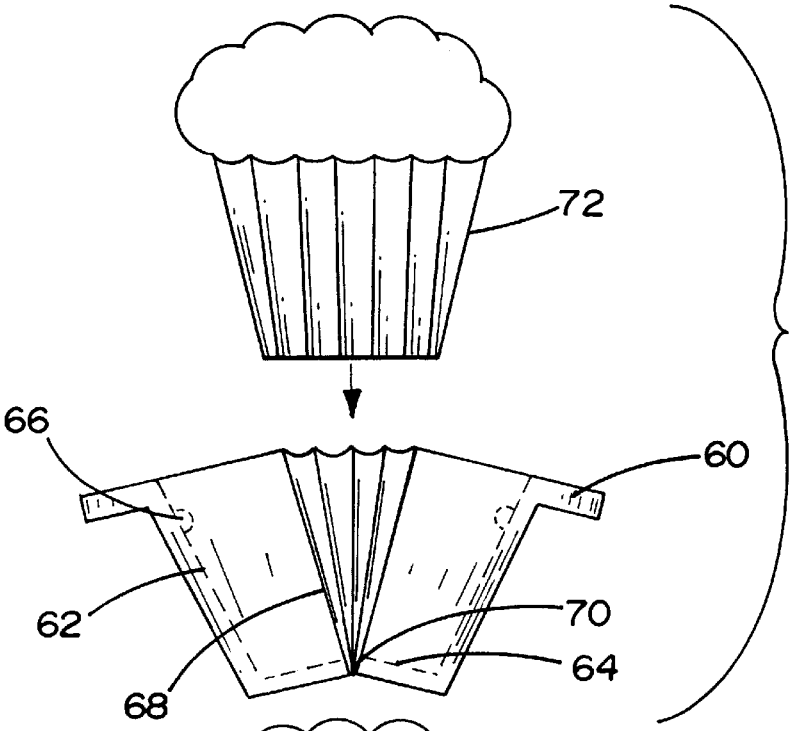
FIG. 5 is a side view of a cupcake and the bottom container member of FIG. 4.
Figure 6:
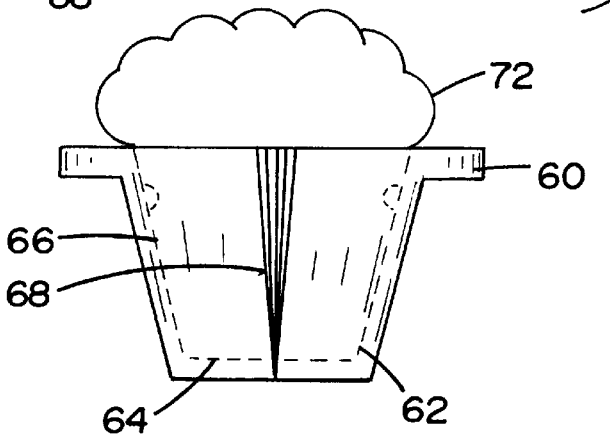
FIG. 6 is a side view of the bottom container member of FIG. 4 shown holding a cupcake.

FIGS. 4–6 show another embodiment of the present invention in which bottom container member 60 is illustrated. Bottom container member 60 has single cup 62, although the container may be designed with more than one cup. A top container member for covering bottom container member 60 may be the same or similar to that shown in FIGS. 1 and 2.

FIG. 4 shows a top view of bottom container member 60 wherein cup 62 has bottom 64, sides 66, and pleats 68. Bottom container member 60 is shown in the arced position in both FIGS. 4 and 5. Bottom 64 of cup 62 has crease 70 at the midline of bottom 64 so that the midline is projected upwardly when bottom container member 60 is arced and pleats 68 are open. Crease 70 of member 60 extends from the pleats on one side of cup 62 to the pleats on the other side of cup 62.

FIGS. 5 and 6 illustrate the benefit of crease 70. Bottom container member 60 is arced in FIG. 5 so that pleats 68 are open and cupcake 72 may be easily placed therein. Bottom 64 is flexible enough to allow crease 70 to flatten to some degree upon placement of cupcake 72 in bottom container member 60 (as shown in FIG. 6), thereby causing pleats 68 to close. Creases, such as crease 70, may be included in any one of the types of cupcake storage containers of the present invention.

Pleats 68 of bottom container member 60 are shown to project inwardly. In this way, pleats 68 may be designed to pinch and hold a stored cupcake when the pleats are closed. Pleats 68, therefore, may serve the same purpose as protrusions 40 of FIGS. 1–3. When the pleats are not designed to pinch the cupcakes, it is preferred to have the pleats extend outwardly rather than inwardly.

Figure 7:
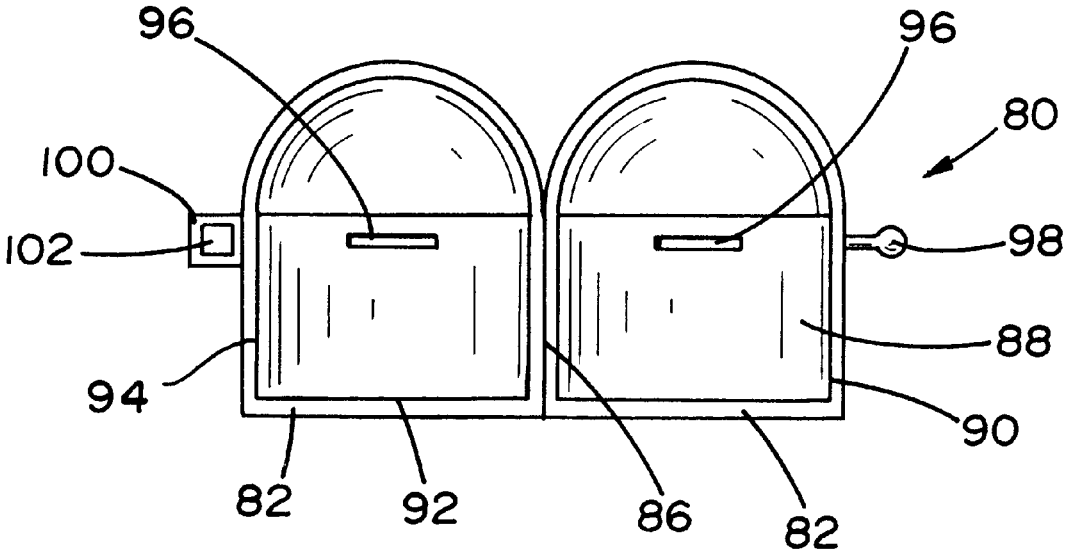
FIG. 7 is a side view of another embodiment of a cupcake storage container according to the present invention.
Figure 8:
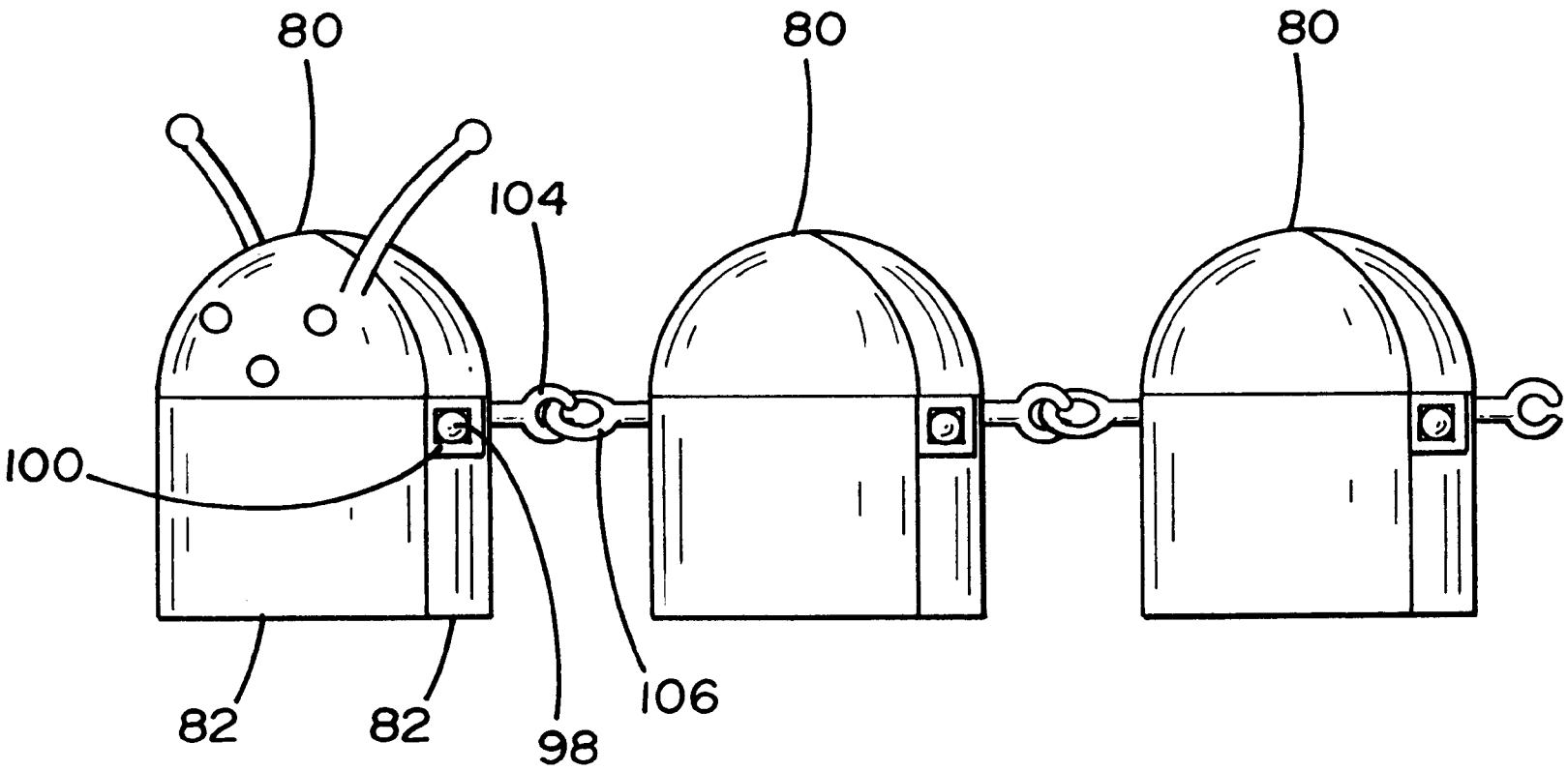
FIG. 8 is a side view of three cupcake storage containers according to the present invention, the containers being connected together.

Another embodiment of the present invention is illustrated in FIGS. 7 and 8 as cupcake storage container 80. Container 80 has side-by-side container members 82 which are connected together at vertical hinge 86. By rotating container members 82 at hinge 86, container 80 may be closed. Once closed together, container members 82 form interior 88 having cup 90 which is sized and shaped to hold a cupcake in a cupcake baking liner. Each container member 82 provides a substantially vertical half of cup 90. The term "substantially vertical half" is used to mean that each container member 82 provides half or close to half of the cup. Some difference in size between the container members 82 is possible. Cup 90 has bottom 92, sides 94 extending upwardly from bottom 92, and protrusions 96 extending inwardly from sides 94. In this embodiment, the protrusions are tabs positioned and sized to press fit or pierce into a stored cupcake just below the top of the cupcake baking liner. The protrusions may also be located above the top of the liner in a manner such that they extend into the cupcake itself.

Container 80 also has a locking mechanism which includes ball 98 and clasp 100 with opening 102. Opening 102 is sized to allow ball 98 to pass therethrough with some applied pressure. Once container members 82 are swung closed, ball 98 may be pushed through opening 102, thereby locking container 80 closed. Many other types of locking mechanisms may be used instead of the one shown.

FIG. 8 shows three containers 80 attached together and designed to look like a caterpillar. In this view, attachment mechanisms on the containers may be seen. Each container 80 has a hook designated by reference numeral 104 on one side of the container and an eye designated by reference numeral 106 on the other side of the container. Hooks 104 and eyes 106 are designed so that each hook 104 may be pressed onto an eye 106, thereby attaching one container 80 to another. Other types of attaching mechanisms may be used in place of the type shown. Attachable containers 80 lend themselves well for children to enjoy at birthday parties or in their lunch boxes, etc.

Figure 9:
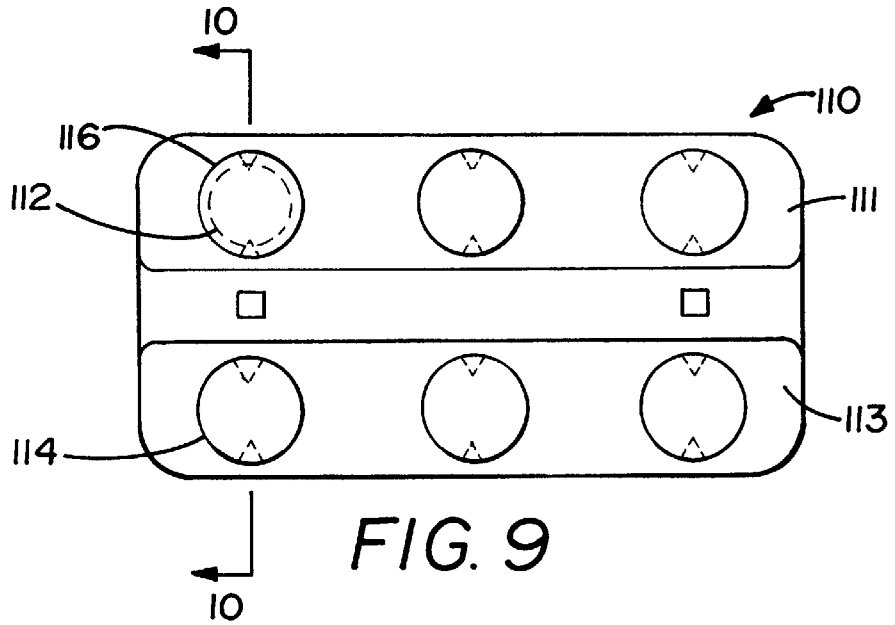
FIG. 9 is a top view of yet another embodiment of a cupcake storage container according to the present invention.
Figure 10:
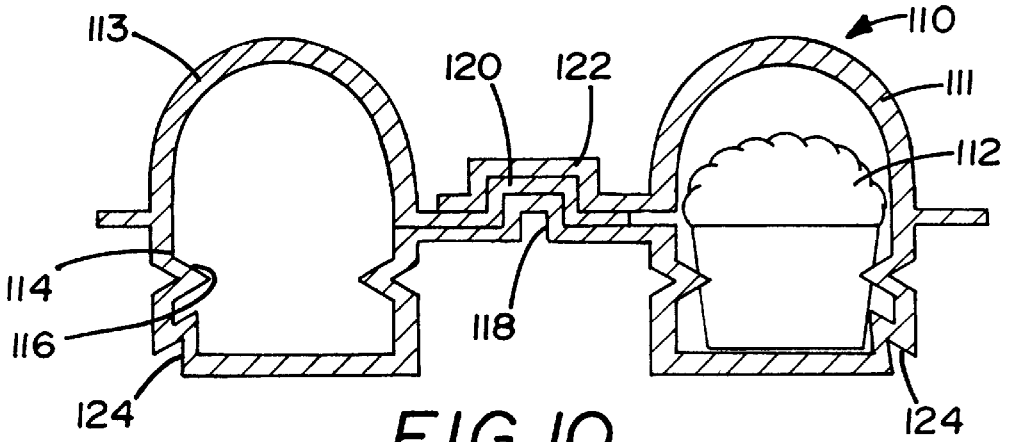
FIG. 10 is a sectional view of the cupcake storage container of FIG. 9, the section taken along line 10—10 and seen in the direction of the arrows.

FIGS. 9–10 illustrate yet another embodiment of a cupcake storage container of the present invention, which is generally designated as reference numeral 110. FIG. 9 shows a top view of container 110 in the assembled position with one cupcake 112 held therein. Container 110 has sides 111 and 113 and six cups 114 for holding cupcakes. Each cup 114 has protrusions 116 which press fit or pierce into the sides of a cupcake for holding the cupcake in place. Again, the protrusions may be in any desirable location.

Figure 11:
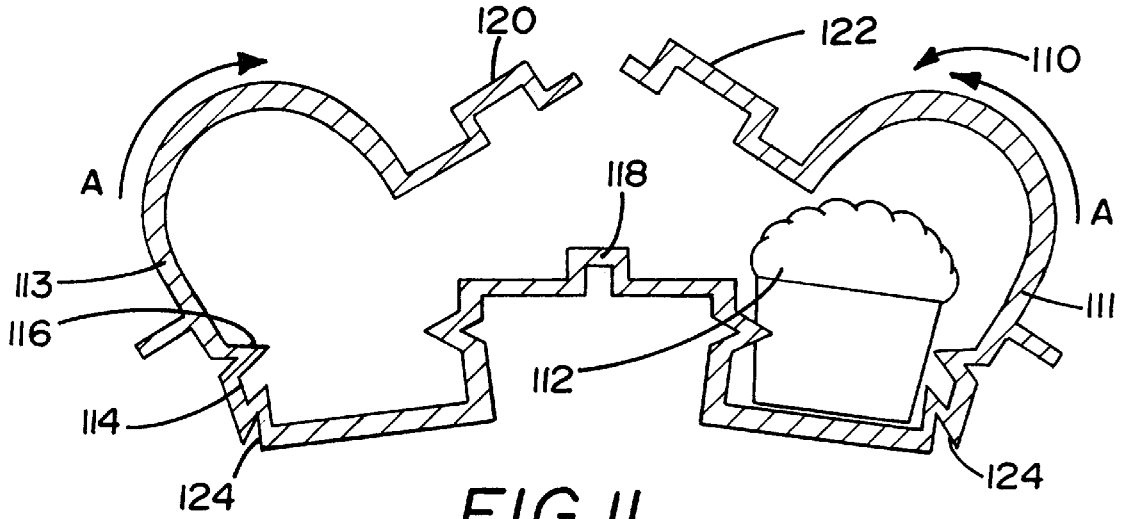
FIG. 11 is a sectional view of the cupcake storage container of FIG. 9, shown in the unassembled position.

FIGS. 10 and 11 are sectional views of container 110. FIG. 10 shows the cross sectional view of container 110 wherein the cross section is taken along line 10—10 in FIG. 9 and shown in the direction of the arrows. FIG. 11 shown the same cross section as FIG. 10, but container 110 is shown in the unassembled position.

Container 110 includes peg 118 and snap-over latch 120 on side 113 and snap-over latch 122 on side 111 which, when snapped-over peg 118 effectively fasten container 110 closed. Container 110 also includes hinges 124 at the outside bottom edge of each cup 114. Hinges 124 allow each side of container 110 to easily swing open as shown in FIG. 11. An additional hinge may be incorporated into the top, if necessary to provide clearance for the frosting.

To use container 110, the sides of container 110 are swung open as shown in FIG. 11. Cupcakes are then placed in each cup 114, and, thereafter, the sides of container 110 are swung closed by rotating the sides in the direction of arrows "A". When the sides of container 110 are swung closed, protrusions 116 effectively hold the cupcakes in place. Snap-over latch 120 or 122 is then placed over peg 118, followed by the other of either snap-over latch 120 or 122 to complete the locking of container 110.

The cupcake storage containers of the present invention may be formed of rubber or plastic, such as polystyrene. The containers may be clear, translucent, or opaque and the material of construction may be colored, e.g., by pigments or dyes. In many cases it is preferred to have the top of the container be clear so that the cupcakes may be seen.

The cupcake storage containers may be formed by any of many conventional techniques, although, in the case of using polystyrene, it is most likely preferred to use blow molding or vacuum molding techniques.

To use the cupcake storage containers of the present invention, a frosted cupcake may be placed in one of the members of the container, e.g., either one of the bottom container members, such as member 16, or one of the side-by-side container members 82, and, subsequently, the container may be closed. When using a container like container 10, it may be desirable to place unfrosted cupcakes in the bottom container member, then frost the cupcakes, and, finally, place the top container member on the bottom container member to close the container.

The industrial applicability of the present invention includes the manufacturing of storage containers, such as cupcake storage containers. The structure of the cupcake storage containers of the present invention serves to reduce the movement of a stored cupcake inside the container even during movement of the container which improves the quality of the cupcake after movement of the container caused during storage, shipping, and other times of transporting the container.

We claim:

1. A cupcake storage container, comprising:

a cupcake—cupcake liner pair coupling, including a cupcake in a cupcake liner;

a top container member having an upwardly-extending recess, said top container member being spaced above the cupcake; and a bottom container member, at least part of the bottom container member being frustum-shaped on the exterior and on the interior, the container members forming an interior, wherein the interior formed by the container members includes the upwardly-extending recess in the top container member and the frustum-shaped interior of the bottom container member, the frustum-shaped interior including a cup which holds the cupcake—cupcake liner pair coupling, the cup having a bottom, sides extending upwardly from the bottom, and a plurality of protrusions extending inwardly from the sides and being spaced around the perimeter of the frustum-shaped interior, the total surface area of the protrusions constituting a minor portion of the inside surface area of the sides, the protrusions being positioned and sized and shaped such that they engage the cupcake—cupcake liner pair coupling, so as to retain the cupcake—cupcake liner pair coupling and hold the cupcake pair coupling against movement inside the cup if the container is tipped or turned over.

2. The cupcake storage container according to claim 1, wherein the protrusions are sized to press fit against a cupcake when contained within the container.

3. The cupcake storage container according to claim 1, wherein the protrusions are pointed and sized to pierce into a cupcake when contained within the container.

4. The cupcake storage container according to claim 1, wherein the protrusions are positioned so that they are just below the top of the cupcake baking liner of a cupcake when contained within the container.

5. The cupcake storage container according to claim 1, wherein each protrusion is in a shape selected from the group consisting of cone-shaped bumps and rounded hill-like bumps.

6. The cupcake storage container according to claim 1, wherein the bottom container member has an upper surface encircling the cup, the upper surface having indentations on opposite sides of the cup to allow easier lifting of a cupcake from the bottom container member.

7. A cupcake storage container, comprising:

a top container member having an upwardly-extending recess; and a bottom container member, at least part of the bottom container member being frustum-shaped on the exterior and on the interior, the container members forming an interior when the top container member is placed on the bottom container member, the interior formed by the container members including the upwardly-extending recess in the top container member and the frustum-shaped interior of the bottom container member, the frustum-shaped interior including a cup which is sized and shaped to hold a cupcake in a cupcake baking liner, the cup having a bottom, sides extending upwardly from the bottom, and a plurality of protrusions extending inwardly from the sides and being spaced around the perimeter of the frustum-shaped interior, such that when the cupcake—cupcake liner pair coupling is placed in the cup, a plurality of protrusions engage the cupcake—cupcake liner pair coupling so as to retain the cupcake—cupcake liner pair coupling and hold the cupcake pair coupling against movement inside the cup if the container is tipped or turned over, and wherein the bottom container member has vertical pleats in opposite sides of the cup, the pleats being spreadable to allow easier removal of a cupcake from the bottom container member and the pleats being compressible to better hold a cupcake when contained in the container.

8. The cupcake storage container according to claim 7, further comprising an upwardly projecting midline crease in the bottom of the cup when the pleats are open, the crease extending from the pleats on one side of the cup to the pleats on the other side of the cup, the bottom of the cup being flexible enough to allow the crease to flatten to some degree when a cupcake is placed in the bottom container member, thereby helping to close the pleats.

9. The cupcake storage container according to claim 7, wherein the pleats are fixed in a compressed state at the bottom of the cup yet spreadable at the top of the cup.

10. A cupcake storage container, comprising:

a top container member and a bottom container member, at least part of the bottom container member being frustum-shaped on the exterior and on the interior, the container members forming an interior when connected together, the frustum-shaped interior of the bottom container member including a cup sized and shaped to hold a cupcake in a cupcake baking liner, the cup having a bottom, sides extending upwardly from the bottom, and at least one protrusion extending inwardly from at least one of the sides, the protrusion being positioned and sized and shaped to press fit against a cupcake when contained within the container to an extent such that, when a cupcake in a cupcake baking liner is placed in the cup, the protrusion is below the top of the cupcake baking liner and the protrusion holds the cupcake in a substantially stationary position relative to the container, the bottom container member further having vertical pleats in opposite sides of the cup, the pleats being spreadable at the top of the cup to allow easier removal of a cupcake from the bottom container member and the pleats being compressible to better hold a cupcake when contained in the container.

11. The cupcake storage container according to claim 10, wherein the protrusion is positioned in the cup at a location selected from the group consisting of (a) near the bottom of the cup and (b) just below the top of a cupcake baking liner of a cupcake when the cupcake is contained within the container.

12. The cupcake storage container according to claim 10, wherein there are a plurality of protrusions.

13. The cupcake storage container according to claim 10, further comprising an upwardly projecting midline crease in the bottom of the cup when the pleats are open, the crease extending from the pleats on one side of the cup to the pleats on the other side of the cup, the bottom of the cup being flexible enough to allow the crease to flatten to some degree when a cupcake is placed in the bottom container member, thereby helping to close the pleats.

14. A cupcake storage container, comprising:

a top container member and a bottom container member having a cup sized and shaped to hold a cupcake in a cupcake baking liner, the container members forming an interior when connected together, the bottom container member having an upper surface encircling the cup, the upper surface having indentations on opposite sides of the cup to allow easier lifting of a cupcake from the bottom container member, the cup further having a bottom, sides extending upwardly from the bottom, and at least one protrusion extending inwardly from at least one of the sides, the protrusion being positioned and protruding inwardly enough to press fit against a cupcake when contained within the container to an extent such that, when a cupcake in a cupcake baking liner is placed in the cup, the protrusion is below the top of the cupcake baking liner and the protrusion holds the cupcake in a substantially stationary position relative to the container, the bottom container member further having vertical pleats in opposite sides of the cup, the pleats being spreadable at the top of the cup to allow easier removal of a cupcake from the bottom container member and the pleats being compressible to better hold a cupcake when contained in the container.

15. A cupcake storage container, comprising:

a top container member and a bottom container member, at least part of the bottom container member being frustum-shaped on the exterior and on the interior, the container members forming an interior when connected together, the frustum-shaped interior including a cup sized and shaped to hold a cupcake in a cupcake baking liner, the cup having a bottom, sides extending upwardly from the bottom, and at least one protrusion extending inwardly from at least one of the sides, the protrusion being positioned and sized and shaped to press fit against a cupcake when contained within the container such that, when a cupcake in a cupcake baking liner is placed in the cup, the protrusion is below the top of the cupcake baking liner and the protrusion holds the cupcake in a substantially stationary position relative to the container, the bottom container member further having vertical pleats in opposite sides of the cup, the pleats being spreadable at the top of the cup to allow easier removal of a cupcake from the bottom container member and the pleats being compressible to better hold a cupcake when contained in the container, the bottom of the cup having an upwardly projecting midline crease when the pleats are open, the crease extending from the pleats on one side of the cup to the pleats on the other side of the cup, the bottom of the cup being flexible enough to allow the crease to flatten to some degree when a cupcake is placed in the bottom container member, thereby helping to close the pleats.

* * * * *